United States Patent [19]

Shibata

[11] 4,161,403

[45] Jul. 17, 1979

[54] COMPOSITE ELECTRICAL CONTACT MATERIAL OF Ag-ALLOY MATRIX AND INTERNALLY OXIDIZED DISPERSED PHASE

[75] Inventor: Akira Shibata, Yokohama, Japan

[73] Assignee: Chugai Denki Kogyo Kabushiki-Kaisha, Japan

[21] Appl. No.: 889,097

[22] Filed: Mar. 22, 1978

[51] Int. Cl.[2] ..... C22C 5/06

[52] U.S. Cl. ..... 75/173 A; 75/173 R

[58] Field of Search ..... 75/173 A, 173 R

[56] References Cited

U.S. PATENT DOCUMENTS

| | | | |
|---|---|---|---|
| 3,666,428 | 5/1972 | Haarbye | 29/195 |
| 3,868,275 | 2/1975 | Godfrey et al. | 148/6.3 |
| 3,930,849 | 1/1976 | Krock et al. | 75/173 A |
| 3,933,486 | 1/1976 | Shibata | 75/173 A |
| 4,050,930 | 9/1977 | Motoyoshi et al. | 75/173 A |
| 4,131,458 | 12/1978 | Satoh et al. | 75/173 R |

OTHER PUBLICATIONS

Harmsen et al., ". . . Ag–Metal Oxide . . . Contacts", Z. Mettkde, 58 (1967) 752.

*Primary Examiner*—L. Dewayne Rutledge
*Assistant Examiner*—Upendra Roy
*Attorney, Agent, or Firm*—Shlesinger, Fitzsimmons & Shlesinger

[57] ABSTRACT

Internally oxidized Ag-Sn alloy electrical contact materials have their electrical characteristics improved by being compounded with other Ag alloys containing metal elements which are in solid solution with Ag and are internally oxidizable. Compounds obtained in accordance with this invention include microscopic silver grain matrices containing Sn oxides and other silver grain matrices which contain metallic oxides of the said other Ag alloys and are intercoalesced with each other and with the first mentioned silver grain matrices, and present macroscopically improved electric characteristics as if they were a single alloy.

4 Claims, No Drawings

COMPOSITE ELECTRICAL CONTACT MATERIAL OF AG-ALLOY MATRIX AND INTERNALLY OXIDIZED DISPERSED PHASE

This invention relates to composite electrical contact materials of Ag-metallic oxides alloys.

Heretofore, various kinds of Ag-metallic oxides alloy electrical contact materials have been developed, in which metallic oxides precipitated in Ag matrices as the result of internal oxidation contribute to improve their electrical characteristics, including contact resistance or anti-welding properties of the materials when used as electrical contacts.

Among such Ag-metallic oxides alloy electrical contact materials, silver-cadmium oxides are popular, while silver-tin oxide-indium oxide type contact materials, which are superior to the aforementioned silver-cadmium oxides particularly with respect to their refractory properties, have been developed by the present inventor, as described in U.S. Pat. Nos. 3,874,941 and 3,933,485. Internally oxidized Ag-Sn-Bi contact materials are also known as described in U.S. Pat. No. 3,933,486, inventorship of which also belongs to the present inventor.

These internally oxidized electrical contact materials, which are mentioned above as typical examples of modern Ag-metallic oxides alloy electrical contact materials, work satisfactorily to make and break electric circuits. However, they are not entirely afforded with all the desirable electric characteristics. To wit, silver-cadmium oxide materials are excellent as to their low contact resistances, but they are somewhat inferior to the others as to their anti-welding properties or refractoriness. On the other hand, silver-tin oxide-bismuth oxide materials have low consumption rates, whereas they are too bricky to undergo certain electric conditions.

Though silver-tin oxide-indium oxide type contact materials have practically acceptable anti-welding properties or low consumption rates as well as contact resistances, said anti-welding properties per se are inferior to those of silver-tin oxide-bismuth oxide materials, while their contact resistances per se are inferior to those of silver-cadmium oxide electrical contact materials.

It is an object, therefore, of this invention to combine such Ag-metallic oxides alloy electrical contact materials, which are microscopic compounds of several Ag-metallic oxides alloys such as Ag-$SnO_2$-$In_2O_3$, Ag-CdO and others, in such manner that each keep their own specific characteristics, and so that their superior specific characteristics are well coordinated, resulting in producing an electric contact material provided with, as a whole or macroscopically, all-round electrical properties including low contact resistances, high anti-weldability, low consumption rates, and so on.

It is easily conceivable and it has been found that such all-round electrical contact material can not be made by merely alloying and internally oxidizing solute metals such as Sn, In, Ni, Zn, Cd and so on with silver, and in such ratios which normally are adequate for producing independently or individually internally oxidized Ag-metallic oxides alloys such as, for examples, internally oxidized Ag-Sn(7%)-In(2%)-Ni(0.3%) alloy, Ag-Zn(3%) alloy, and Ag-Cd(10%).

This is because, since each such Ag-metallic-internally oxidized alloy electrical contact material contains solute metal elements at the maximum or proper ratios which can be internally oxidized to place the solute metal elements in a solid solution with a Ag matrix, they can hardly be internally oxidized and can hardly make a solid solution with Ag matrices when they are added as solute metals, which constitute by themselves another Ag-metallic oxides alloy material.

More concretely, when one considers an electrical contact material having lowermost contact resistance, such as one provided by internally oxidized Ag-Cd(10%), and having as well excellent anti-welding properties, such as those provided by Ag-Sn(7%)-In(2%)-Ni(0.3%) internally oxidized alloy, he thinks of these melted together to form an alloy of Ag-Cd(10%)-Sn(7%)-In(2%)-Ni(0.3%). This alloy shall never produce a practically employable contact material on account of the aforementioned reasons, viz., the solute metals are unable to be in a solid solution with Ag and also cannot be internally oxidized.

The present inventor has a copending U.S. patent application Ser. No. 807,910 filed June 20, 1977 disclosing that Ag-SnO alloy contact materials, which are of such dimensions that they are hard to achieve internal oxidation, may be produced by metallurgicatly integrating pieces of said alloy material, those pieces being of such dimensions that they are easily internally oxidized. This invention is a further development of that concept.

In this invention, for example, more than one kind of alloy, each consisting of a silver matrix and solute metal elements in amounts which form a solid solution with the silver matrix, and which are internally oxidizable, are employed. These alloys, which are in the form of granules, wires, or plates, and so on, are compounded together to form a compact alloy by subjecting them to mechanical binding, sintering or forging operations. All the alloys may or may not have been internally oxidized before being compounded. Or, one or some of them may have been internally oxidized before being integrated. When the compact alloy comprises a constituent alloy which has not been internally oxidized, it has to be subjected to internal oxidation after a compact alloy has been drawn to a reduced dimension.

It will be observed that the compact alloy, which is a medium or intermediate product of this invention, and which is made of more than one Ag-alloy, each containing either one or a combination of Sn, Sn-In, In, Zn, Sb, Cd, Pb, Al as principal solute metals in solid solutions with a Ag-matrix, and each being internally oxidizable, appears externally to be no different than an alloy which consists of the aforementioned solute metals which are all melted and alloyed together with silver.

It shall be noted to the contrary that the former differs largely from the latter with respect to the fact that each of the Ag-alloys, which constitute the present invention compact alloy or compound alloy, exists as individual or independent silver grains of about 0.5 to 100$\mu$ which contain their own internally oxidized solute metals, while in the latter the internally oxidized solute metals make a single Ag-alloy and are not discernable as different grain alloys.

EXAMPLE 1

30 pieces of wire 0.5 mm in diameter of each of the following alloys were tied up in a bundle.

Ag-Sn(5%)-In(2%)-Ni(0.2%)—(A)
Ag-Cd(10%)-Ni(0.2%)—(B)
Ag-Zn(5%)-Ni(0.2%)—(C)

The bundle was drawn to a wire of 2.0 mm in diameter, by hot rolling. The wire thus obtained was subjected to internal oxidation for 40 hours at a temperature of 700° C. in an oxidizing atmosphere.

This wire was made into rivet-shaped electrical contacts each having a discal head portion 4 mm in diameter and 2 mm in thickness, and a stem portion 2 mm in diameter and 2 mm in length. Microscopic observations disclosed that in the wire structure silver grains of 0.5 to 100μ were dispersed throughout the silver matrix of the wire, said grains each having corresponding solute metal elements which were contained originally in the silver matrix of the aforementioned alloys (A), (B) and (C) as solid solutions therewith and which were precipitated in the corresponding silver grains as oxides. In other words, microscopically speaking, the wire is a compound of grain form of the aforementioned three alloys which were internally oxidized. The contact made from said wire had, moreover, macroscopically speaking, electric characteristics which are comparable to a combination or coordination of the specific characteristics of the three internally oxidized alloys, viz., the low contact resistance inherent to Ag-CdO alloy due to the decomposition of CdO at a temperature lower than the melting point of silver, and the high refractoriness of ZnO, $SnO_2$ and $In_2O_3$. It shall be readily known that when all the solute elements of the aforementioned alloys are melted and cast together to a single alloy, this alloy cannot be internally oxidized.

Test Results (1) Contact resistance

The contact of the aforementioned dimensions made in accordance with this invention was measured for its contact resistance, while contact resistances of contacts of the same dimensions and each made from the aforementioned respective alloys (A), (B), (C) were measured also for comparison with the former.

Test was made as precribed in A.S.T.M.-30, in which voltage drops were measured at 1A, DC 6V.

Load - AC 200V
13.5 A
Pf = 5.0%
Contact pressure - 100 g.

| Cycles | 0 | 5,000 | 10,000 |
|---|---|---|---|
| alloys | voltage drop (m Ω) | | |
| (A) | 0.69 | 3.49 | 2.48 |
| (B) | 0.58 | 0.9 | 0.91 |
| (C) | 0.65 | 8.5 | * |
| this invention (Example 1) | 0.4 | 0.44 | 0.38 |

*test was discontinued on account of high temperature rise (2) Antiweldability (A.S.T.M.)
Load - AC 200 V
13.5 A
Pf - 5.0%
Contact and release pressures - 100 g. each
Switching frequency - 60 times/minute
Switching operations - 100,000 times

| alloys | welding occurrence (times) |
|---|---|
| (A) | 0 |
| (B) | 3 |
| (C) | 2 |
| this invention (Example 1) | 0 |

EXAMPLE 2

Wires of 0.5 mm diameter of the following alloys (D), (E), (F) were internally oxidized respectively for 6 hours at a temperature of 700° C. in an oxidizing atmosphere.

(D)—Ag-Sn(7%)-In(2%)-Ni(0.3%)
(E)—Ag-Zn(3%)
(F)—Ag-Cd(10%)

50 Pieces of wires of the alloy (D) thus internally oxidized, and 25 pieces each of wires of the alloys (E) and (F) thus internally oxidizied were tied up into a bundle. This bundle was drawn by hot extrusion to a wire of 2.0 mm diameter from which was made rivet shaped contacts of the same dimensions as in Example 1. These contacts and contacts made from the respective alloys (D), (E) and (F) were subjected to contact breaking tests.

Circuit:
1 phase, 262V 1.5KA p.f. 0.56 lag
3 phase, 460V 1.5KA p.f. 0.43 lag
"O" "CO" "O" "CO"

Insulation resistances after breakings:

| | |
|---|---|
| alloy (D) | 120M up |
| (E) | 80M up |
| (F) | 30M up |
| this invention alloy compound (Example 2) | 130M up |

EXAMPLE 3

70 Pieces of wire 0.5 mm in diameter of Ag-Sn(7%)-In (2%)—alloy (G), which had been internally oxidized, and 30 pieces of wire of the same diameter made of Ag-Cd(10%)—alloy (F), which had not been internally oxidized, were tied up in a bundle. This bundle was subjected to a hot extrusion, and made to a wire of 2 mm in diameter. This wire was internally oxidized for 6 hours at a temperature of 700° C. in an oxidizing atmosphere. The wire was made into rivet-shaped contacts of the dimensions the same as in Example 1. These contacts and others made from the respective alloys (G) and (F) were subjected to inching tests of magnetic switch.

Test condition:
Voltage—200V
Current—100A (reactive load)
p.f.—0.3 lag
Frequency—30 times/min
Cycles—50,000 times Test results (wear loss):

| | |
|---|---|
| alloy (G) | 56 mgr |
| (F) | 112 mgr |
| this invention alloy compound (Example 3) | 54 mgr |

It was found through experiments that the following alloy systems are utilizable as effective constituent alloys of the present invention compound alloys, while Ag-Sn(3 to 11 weight %)-In (1.0 to 13 weight %) system alloy and/or Ag-Sn (3 to 11 weight %)-Bi(0.01 to 2 weight %) are essential elements of the compound alloys in accordance with this invention:

Ag-Ca(0.01 to 2 weight %)
Ag-Cd(0.01 to 25 weight %)
Ag-Mn(0.01 to 5 weight %)
Ag-Sb(0.01 to 5 weight %)
Ag-Zn(0.01% to 4 weight %)
Ag-Pb(0.01 to 10 weight %)

If these solute metals are present in more than the maximum limitations, their internal oxidation, pressing and other processing, or electric characteristics will be adversely affected, while electric characteristics can hardly be improved if they are less than the lower limitations.

What I claim is:

1. A composite electircal contact material having dispersed therein alloys of silver and solute metal elements, said alloys including, a primary alloy comprising a primary silver matrix, and 3 to 11% by weight of tin and 1 to 13% by weight of indium which are in solid solution with said primary silver matrix, and a subsidiary alloy of a system different from the primary alloy and comprising another silver matrix and one or more metal elements, said elements being of such percentages that they are in solid solution with said other silver matrix, and being internally oxidized, and said composite material comprising a plurality of said primary silver grain matrices containing the solute metal elements of the primary alloy, and a plurality of said other silver grain matrices containing solute metal elements of the subsidiary alloy and intercoalescing with each other and with said primary silver grain matrices, said solute metal elements having been precipitated in their parental matrices as oxides by internal oxidation of the alloys, said subsidiary alloy being selected from a group consisting of Ag alloy comprising Sn(3%-11% by weight) and Bi (0.01%-2% by weight), Ag alloy comprising Ca(0.01%-2% by weight), Ag alloy comprising Cd(0.01%-25% by weight), Ag alloy comprising Mn(0.01%-5% by weight), Ag alloy comprising Sb (0.01% -4% by weight), Ag alloy comprising Zn(0.01%-5% by weight), and Ag alloy comprising Pb(0.01%-10% by weight).

2. A composite electrical contact material as claimed in claim 1, which is made by fabricating the alloys in the form of granules, wires or plates.

3. A composite electrical contact material having dispersed therein alloys of silver and solute metal elements, said alloys including a primary alloy comprising a primary silver matrix, and 3 to 11% by weight of tin and 0.01 to 2% by weight of bismuth which are in solid solution with said primary silver matrix, and a subsidiary alloy of a system different from the primary alloy and comprising another silver matrix and one or more metal elements, said elements being of such percentages that they are in solid solution with said other silver matrix, and being internally oxidized, and said composite material comprising a plurality of said primary silver grain matrices containing the solute metal elements of the primary alloy, and a plurality of said other silver grain matrices containing solute metal elements of the subsidiary alloy, said solute metal elements having been precipated in their parental matrices as oxides by internal oxidation of the alloys, said subsidiary alloy being selected from a group consisting Ag alloy comprising Sn(3%-11% by weight) and In (1%-13% by weight), Ag alloy comprising Ca(0.01%-2% by weight), Ag alloy comprising Cd(0.01%-25% by weight), Ag alloy comprising Mn (0.01%-5% by weight), Ag alloy comprising Sb(0,01%-4% by weight), Ag alloy comprising Zn (0.01%-5% by weight), and Ag alloy comprising Pb (0.01%-10% by weight).

4. A composite electrical contact material as claimed in claim 3, which is made by fabricating the alloys in the form of granules, wires or plates.

* * * * *